United States Patent [19]

Brown

[11] 3,946,936

[45] Mar. 30, 1976

[54] PAPERBOARD BLANK AND CARTON

[75] Inventor: Lyman J. Brown, La Grange, Ill.

[73] Assignee: Bates Printing Specialties, Inc., Cicero, Ill.

[22] Filed: Oct. 4, 1974

[21] Appl. No.: 512,346

[52] U.S. Cl. ..... 229/38; 229/16 A; 206/806

[51] Int. Cl.[2] ..... B65D 5/08; B65D 25/22

[58] Field of Search ..... 229/38, 16 A, 52 B; 206/491, 806

[56] References Cited

UNITED STATES PATENTS

| | | | |
|---|---|---|---|
| 1,223,013 | 4/1917 | Wilson | 229/38 X |
| 1,822,936 | 9/1931 | Reichel | 229/16 A |
| 2,105,025 | 1/1938 | Curtis | 206/806 X |
| 2,659,524 | 11/1953 | McElwee | 229/16 A |
| 2,995,238 | 8/1961 | Casselman | 229/38 X |
| 3,625,411 | 12/1971 | Cote | 206/806 X |
| 3,814,303 | 6/1974 | Smith | 229/38 |

*Primary Examiner*—Davis T. Moorhead
*Attorney, Agent, or Firm*—Kinzer, Plyer, Dorn & McEachran

[57] ABSTRACT

An elongated one piece paperboard blank which can be erected into a carton which can be hung on a hook of a pegboard display. The blank forms a carton having a solid bottom and flaps on each side so that the contents will not readily fall out of the carton when it is hanging on a hook. For added strength, the carton has a two-ply hanger member which is formed by hanger panels located at opposite ends of the blank. Aligned apertures to receive a pegboard hook are formed in each hanger panel. The blank is folded and the juxtapositioned hanger panels are adhered together by a suitable adhesive. The folded blank can be stored and shipped in this partially assembled condition. The carton is erected from the folded blank without the necessity of additional gluing operations.

3 Claims, 3 Drawing Figures

25
95
21
93
17
11
91
85
86
86
85
89
83
-74-
81
77
79
71
75
69
73
72
67
57
65
-63-
-55-
59
-49-
-53-
-61-
73
72
71
69
51
45
-35-
43
39
41
85
86
37
86
85
31
33
15
19
23

PAPERBOARD BLANK AND CARTON

SUMMARY OF THE INVENTION

This invention is concerned with a one piece paperboard blank which can be folded into a carton adapted to hold merchandise and be supported on a hook of a pegboard merchandise display.

An object of this invention is a paperboard blank which can be folded to form a carton having a solid bottom and side access flaps and which can be hung on a hook of a pegboard merchandise display.

Another object is a one piece paperboard blank for a pegboard hanging carton which is connected together by adhesive applied only to the hanger panels.

Another object is a one piece paperboard blank which can be erected into a carton having a two-ply hanger member.

Another object is a one piece paperboard blank which can be folded into a pegboard hanging carton having access flaps on both the right and left sides of the carton.

Another object is a one piece paperboard blank for a carton which may be preassembled into a flat, folded condition with the hanger panels adhered to each other so that the carton can be erected without the additional application of adhesive.

Other objects may be found in the following description, claims and drawings.

BRIEF DESCRIPTION OF THE DRAWINGS

The invention is illustrated more or less diagramatically in the following drawings wherein.

DESCRIPTION OF THE PREFERRED EMBODIMENT

Figure 1:
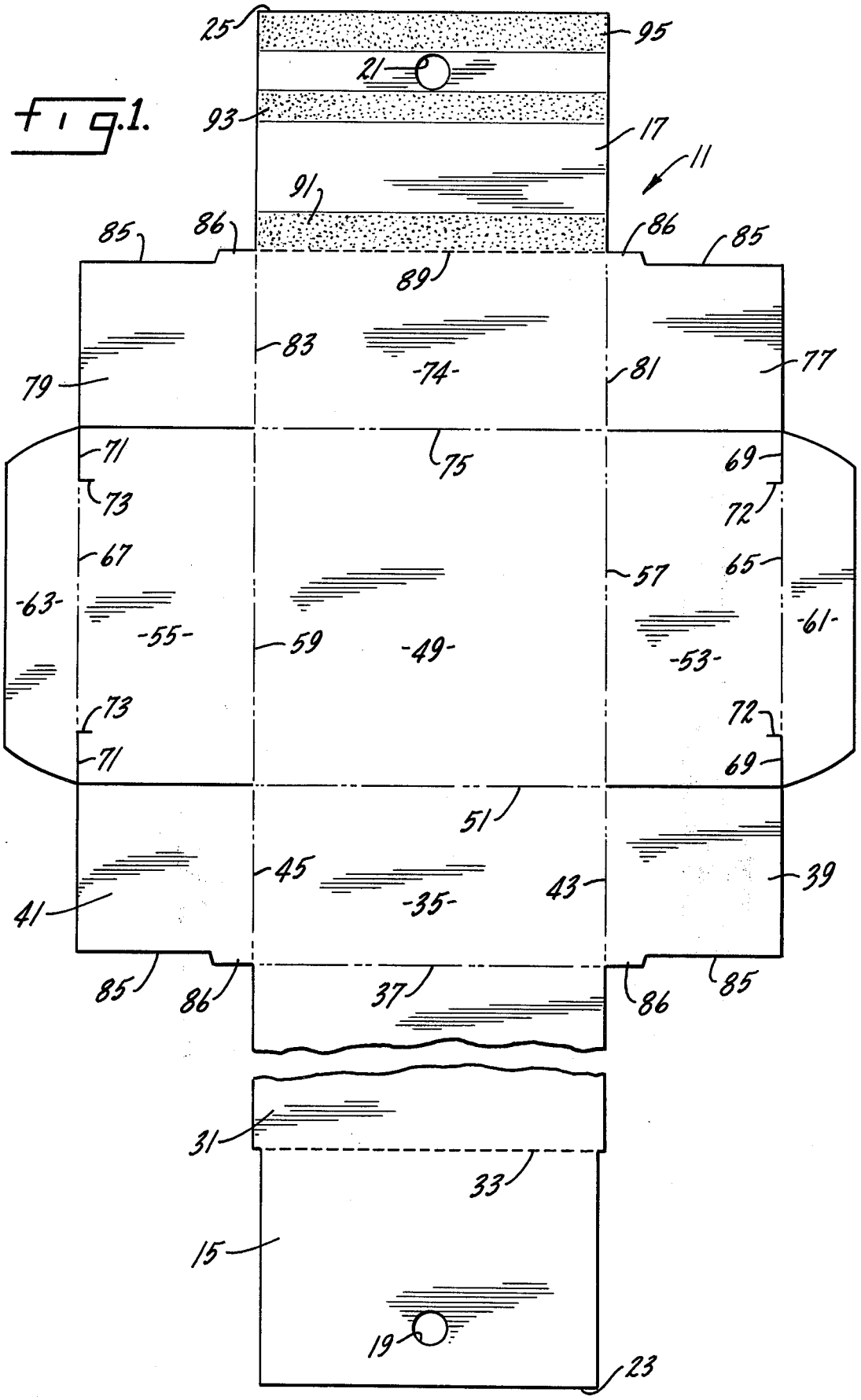
FIG. 1 is a plan view of a one piece paperboard blank which can be erected to form a hook supported carton of this invention.

A one piece paperboard blank 11 which can be folded into the pegboard display hanging carton 13 of this invention is shown in FIG. 1. The blank 11 includes hanger panels 15 and 17, which preferably are rectangular, located at opposite ends thereof. Hanger panel 15 is formed with a circular aperture 19 and hanger panel 17 is formed with a circular aperture 21 with both apertures having essentially the same diameter. The apertures are located adjacent to opposite end edges 23 and 25 respectively of the panels 15 and 17 so that the apertures will align when the panels are positioned in face-to-face relationship and adhered to each other to form a two-ply hanger member 27 in the manner shown in FIGS. 2 and 3 of the drawings.

The hanger panel 15 is hingedly connected to a rear panel 31 of the carton by a fold line 33 which may be perforated. A bottom panel 35 is hinged to the opposite end edge of the rear panel by a fold line 37. The fold lines formed in the blank 11 may most conveniently be formed by scoring the paperboard with a steel rule die. Side flaps 39 and 41 are hinged to opposite side edges of the bottom panel 35 by fold lines 43 and 45, respectively. A front panel 49 is hinged to the opposite end of the bottom panel 35 by a fold line 51. Side flaps 53 and 55 are hinged to opposite side edges of the front panel 49 by fold lines 57 and 59, respectively. Tabs 61 and 63 are hinged to the outside edges of the flaps 53 and 55, respectively, by fold lines 65 and 67. The fold lines 65 and 67 are slit, respectively, at 69 and 71 with the slits extending inwardly from opposite ends of the fold lines 65 and 67. The slits continue into the flaps 53 and 55 obliquely at 72 and 73, respectively. A top panel 74 is hinged to the opposite end edge of the front panel 49 by a fold line 75. Side flaps 77 and 79 are hinged to the opposite side edges of the top panel by fold lines 82 and 83, respectively.

The edges of the side flaps 39 and 41 and the edges of the side flaps 77 and 79 which face the logitudinal ends of the blank 11 are notched at 85 to form tabs 86. Hanger panel 17 is connected to the opposite end edge of top panel 74 by a perforated fold line 89. Strips of adhesive 91, 93 and 95 are applied to one surface of the hanger panel 17 to enable the panel 15 and 17 to be adhered together in facing relationship to form a two-ply hanger member 27.

Figure 2:
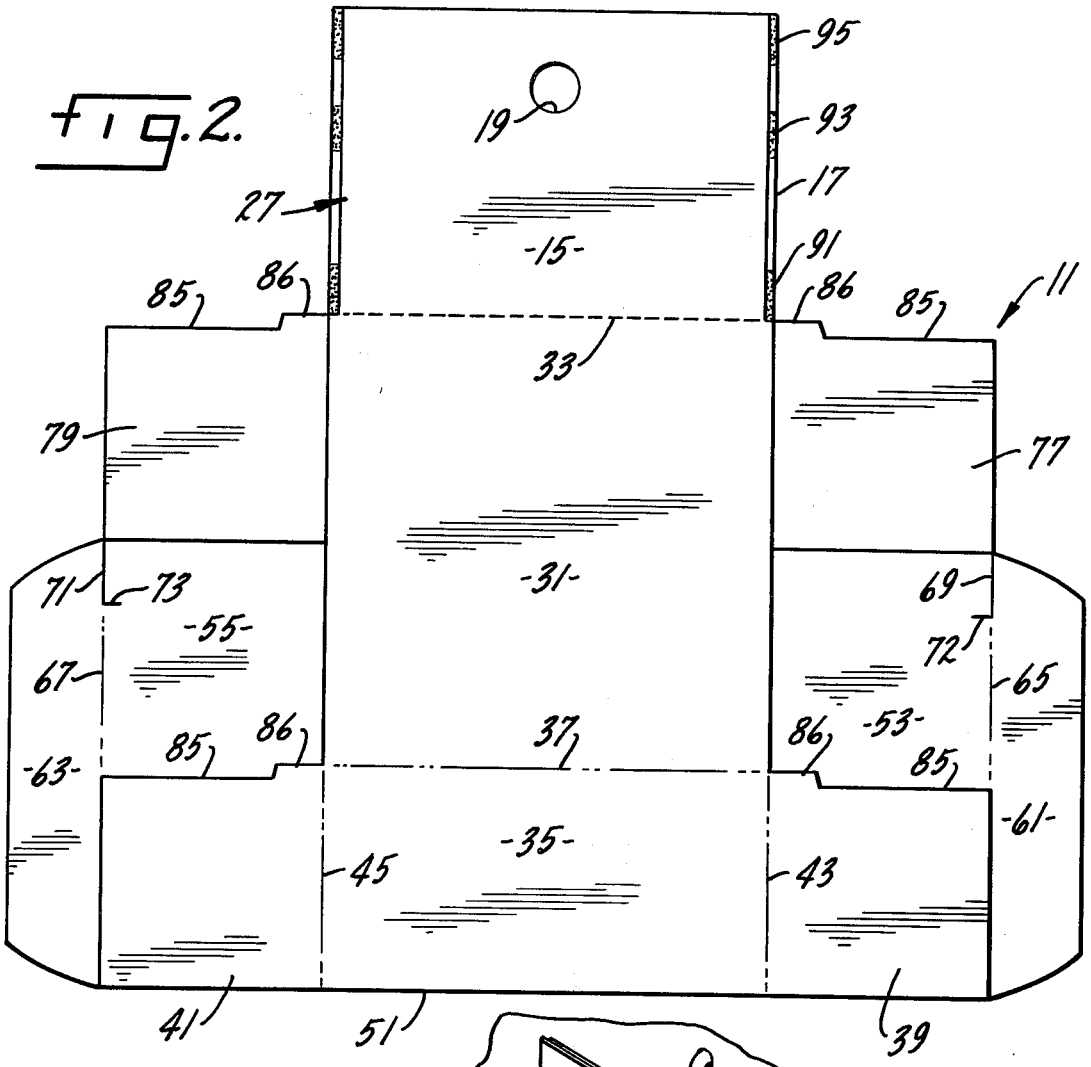
FIG. 2 is a plan view of the paperboard blank in a folded condition for shipment and storage.
Figure 3:
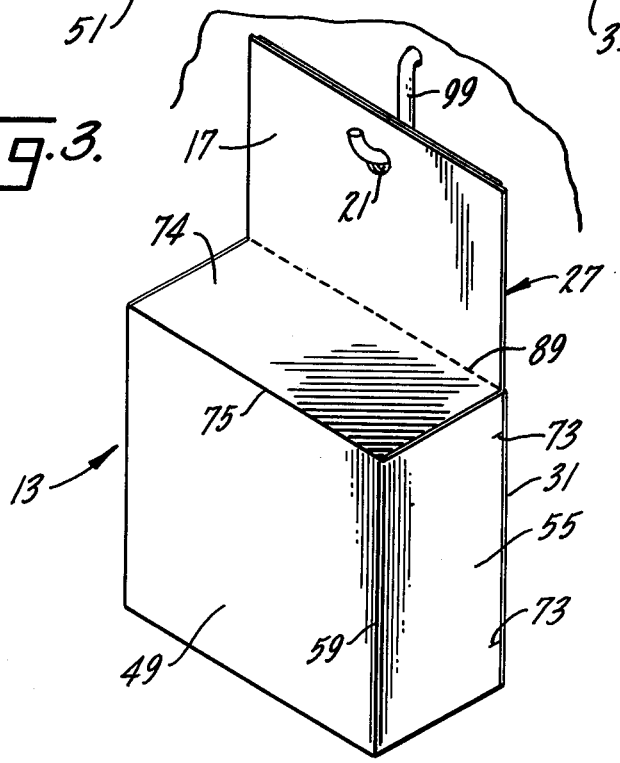
FIG. 3 is perspective view of the completely erected carton mounted on a hook of a pegboard merchandise display.

As a preliminary step in the forming of the carton 13, the blank 11 is folded about fold line 51 thereby positioning the hanger panels 15 and 17 in face-to-face relation in the manner shown in FIG. 2. When the hanger panels are so positioned, the adhesive strips 91, 93 and 95 of the hanger panel 17 engage the hanger panel 15. Upon the application of pressure, the panels are adhered, thereby forming the two-ply hanger member 27. The folded and adhered blank 11 can be stored and shipped in this condition.

In erecting the carton 13 from the folded and adhered blank 11 of FIG. 2, the bottom and top panels 35 and 74 are folded about their fold lines 37, 89, 51 and 75 to extend at right angles to the front panel 49 and rear panel 31 thereby changing the blank 11 into a rectangular tube. The carton may now be filled with merchandise inserted into the carton from either the right or left sides. To close the carton, the bottom and top panel side flaps 39, 41, 77 and 79 are then folded inwardly and the front panel side flaps 53 and 55 are folded up against the bottom and top panel side flaps with the tabs 61 and 63 projecting into the carton. The slits 69 and 71 formed between the tabs 61, 63 and the front panel side flaps 39, 41, 77 and 79 to lock the tabs 61, 63, and the side flaps 53 and 55 in position. The carton may now be hung on a hook 99 of the pegboard display.

I claim:

1. An elongated foldable, one piece paperboard blank for a pegboard hanging carton for merchandise, including:

a hanger panel located at each end of said blank, said hanger panels each having an aperture formed therein adjacent to opposite end edges thereof with said apertures adapted to be aligned when said panels are positioned in face-to-face relationship to form a two-ply hanger member, a rear panel hinged to one end edge of one of said hanger panels by a perforated fold line, a bottom panel hinged to the opposite end edge of said rear panel by a fold line, side flaps hinged to the opposite side edges of said bottom panel by fold lines, a front panel hinged to the opposite end edge of said bottom panel by a fold line, side flaps hinged to the opposite side edges of said front panel by fold lines, a tab hinged to the outer side edges of each of said front panel side flaps by fold lines, each of said tabs having a width less than the width of its flap, a top panel hinged to the opposite end edges of said front panel by a fold line, side flaps hinged to the opposite side edges of said top panel by fold lines, said opposite end edge of said top panel being hinged to the other of said rectangular hanger panels by a perforated fold line, and adhesive applied to one of said hanger panels to connect said hanger panels to form said two-ply hanger member.

2. The paperboard blank of claim 1 in which the fold lines between said tabs and said front panel side flaps are slit part way from the opposite ends thereof.

3. A carton adapted to be supported on a hook of a pegboard merchandise display, said carton including:

a back panel, a bottom panel hingedly connected to said back panel and extending at right angles thereto, a front panel hingedly connected to said bottom panel and extending at right angles thereto with said front panel extending generally parallel to said rear panel and positioned in front thereof, a top panel hingedly connected to said front panel and extending between said front and rear panels, a first hanger hingedly connected to said rear panel by a perforated line and extending in the plane of said rear panel, a second hanger panel hingedly connected to said top panel by a perforated line and extending at right angles to said top panel, said first and second hanger panels being adhesively adhered together to form a hanger member for said carton, an aperture in each hanger panel with said apertures aligning when said panels are adhered to each other to provide a supporting aperture for said hanger member, outer side flaps hingedly connected to opposite side edges of said front panel, tabs hingedly connected to said outer side flaps, and inner side flaps hingedly connected to opposite side edges of said top and bottom panels, with each of said side flaps extending approximately halfway between top and bottom panels, said outer and inner side flaps being engageable to close the sides of said carton with said tabs of outer side flaps being positioned against said rear panel.

* * * * *